US010529282B2

(12) United States Patent
Kim

(10) Patent No.: US 10,529,282 B2
(45) Date of Patent: Jan. 7, 2020

(54) PIXEL CIRCUIT AND ORGANIC LIGHT-EMITTING DIODE DISPLAY INCLUDING THE SAME

(71) Applicant: Samsung Display Co., Ltd., Yongin-si, Gyeonggi-do (KR)

(72) Inventor: Chulho Kim, Yongin-si (KR)

(73) Assignee: SAMSUNG DISPLAY CO., LTD., Yongin-si, Gyeonggi-Do (KR)

( * ) Notice: Subject to any disclaimer, the term of this patent is extended or adjusted under 35 U.S.C. 154(b) by 134 days.

(21) Appl. No.: 15/356,385

(22) Filed: Nov. 18, 2016

(65) Prior Publication Data

US 2017/0148383 A1 May 25, 2017

(30) Foreign Application Priority Data

Nov. 23, 2015 (KR) ..... 10-2015-0163975

(51) Int. Cl.
*G09G 3/3233* (2016.01)
*G09G 3/3266* (2016.01)
*G09G 3/3275* (2016.01)

(52) U.S. Cl.
CPC ..... *G09G 3/3233* (2013.01); *G09G 3/3266* (2013.01); *G09G 3/3275* (2013.01);
(Continued)

(58) Field of Classification Search
CPC .. G09G 3/3233; G09G 3/3258; G09G 3/3266; G09G 3/3291; G09G 3/3241; G09G 3/325; G09G 3/3283; G09G 3/3208; G09G 2300/0819; G09G 2300/0426; G09G 2300/043; G09G 2300/088; G09G 2300/0885; G09G 2300/089;
(Continued)

(56) References Cited

U.S. PATENT DOCUMENTS

2001/0038098 A1* 11/2001 Yamazaki ..... G09G 3/3233 257/72
2002/0118150 A1* 8/2002 Kwon ..... G09G 3/3233 345/76

(Continued)

FOREIGN PATENT DOCUMENTS

KR 10-2013-0133500 A 12/2013
KR 10-2014-0028921 A 3/2014
KR 10-2014-0096862 A 8/2014

*Primary Examiner* — Nitin Patel
*Assistant Examiner* — Amen Woldesenbet Bogale
(74) *Attorney, Agent, or Firm* — F. Chau & Associates, LLC

(57) ABSTRACT

A pixel circuit and OLED display including the same are disclosed. In one aspect, the pixel circuit includes an OLED and a driving transistor including a drain electrode and a gate electrode electrically connected to a first node. The driving transistor is configured to supply a driving current to the OLED based on a voltage of the gate electrode; a storage capacitor electrically connected to the first node. A compensating transistor is electrically connected between the first node and the drain electrode of the driving transistor and configured to be controlled by a scan signal. A diode unit is electrically connected between the first node and the compensating transistor, and the compensating transistor is electrically connected to the first node via the diode unit.

19 Claims, 6 Drawing Sheets

(52) U.S. Cl.
CPC ..... *G09G 2300/043* (2013.01); *G09G 2320/0233* (2013.01); *G09G 2340/0407* (2013.01)

(58) Field of Classification Search
CPC ... G09G 2300/0895; G09G 2320/0238; G09G 2320/02; G09G 2320/0209; G09G 2320/0233; G09G 2320/045; G09G 3/32–3291; G09G 2300/0439–0465; G09G 2300/0809–0871; G09G 2320/04; H01L 27/32; H01L 27/3202; H01L 27/3204; H01L 27/3206; H01L 27/3211; H01L 27/3213; H01L 27/3216; H01L 27/3218; H01L 27/3225; H01L 27/3227; H01L 27/323; H01L 27/3232; H01L 27/3237; H01L 27/3239; H01L 27/3241; H01L 27/3244; H01L 27/3248; H01L 27/326; H01L 27/3262; H01L 27/3265
See application file for complete search history.

(56) References Cited

U.S. PATENT DOCUMENTS

2003/0062844 A1* 4/2003 Miyazawa ..... G09G 3/3241 315/169.3
2009/0201231 A1* 8/2009 Takahara ..... G09G 3/3233 345/76
2009/0213049 A1 8/2009 McCreary
2011/0304593 A1* 12/2011 Huang ..... G09G 3/3225 345/204
2013/0088474 A1* 4/2013 Wang ..... G09G 3/3258 345/211
2013/0321375 A1 12/2013 Ka et al.
2014/0027719 A1* 1/2014 Kim ..... H05B 33/0896 257/40
2014/0062982 A1 3/2014 Lee et al.
2014/0198136 A1* 7/2014 Lee ..... G09G 3/3266 345/690
2014/0210867 A1* 7/2014 Kwon ..... G09G 3/3258 345/690

* cited by examiner

PIXEL CIRCUIT AND ORGANIC LIGHT-EMITTING DIODE DISPLAY INCLUDING THE SAME

CROSS-REFERENCE TO RELATED APPLICATION

This application claims the benefit of Korean Patent Application No. 10-2015-0163975, filed on Nov. 23, 2015, in the Korean Intellectual Property Office, the disclosure of which is incorporated herein in its entirety by reference.

BACKGROUND

Field

The described technology generally relates to a pixel circuit and an organic light-emitting diode (OLED) display including the same.

Description of the Related Technology

A basic OLED display pixel circuit includes an OLED and a driving transistor. The driving transistor controls the amount of a current to be supplied to the OLED according to a voltage difference between a gate and a source of the driving transistor. The circuit also includes a switching transistor to transmit a data voltage to the driving transistor to control luminance of the OLED. The circuit further includes a storage capacitor connected to the driving transistor to maintain the luminance of the OLED during a frame and to maintain a voltage between the gate and the source of the driving transistor.

In order to display a more vivid image, the resolution of the OLED display circuit increase, and the size of each pixel must decrease. In order to reduce the size of the pixel, the storage capacitor must be made smaller.

When a voltage level of a gate signal to control a transistor of the pixel is changed, a gate voltage of the driving transistor can inadvertently change. As a result, the luminance of the OLED may change during the frame. Moreover, a parasitic capacitance between a channel and a gate of the transistor may change according to degradation of the transistor with usage. Thus, it is difficult to compensate for a change of the gate voltage of the driving transistor when a variable amount gate voltage changes proportionally to a change of the voltage level of the gate signal.

The above information disclosed in this Background section is only for enhancement of understanding of the background of the invention and therefore it can contain information that does not constitute the prior art that is already known in this country to a person of ordinary skill in the art.

SUMMARY OF CERTAIN INVENTIVE ASPECTS

One inventive aspect relates to a pixel circuit to maintain a gate voltage of a driving transistor of a pixel constant, and an OLED display having the same.

Another aspect is a pixel circuit that includes an OLED, a driving transistor including a gate connected to a first node and supplying a driving current to the OLED according to a voltage of the gate, a storage capacitor connected to the first node, a compensating transistor connected between the first node and a drain of the driving transistor and controlled by a scan signal, and a diode unit connected between the first node and the compensating transistor.

According to one or more embodiments, an absolute value of a threshold voltage of the driving transistor is greater than an absolute value of a threshold voltage of the diode unit.

According to one or more embodiments, the diode unit is a diode-connected transistor which includes a drain and a gate, which are commonly connected to the first node, and a source, which is connected to the compensating transistor.

According to one or more embodiments, the compensating transistor includes a pair of transistors which are simultaneously turned on according to the scan signal and which are connected in series.

According to one or more embodiments, the pixel circuit further includes a scan transistor to transmit a data voltage to a source of the driving transistor in response to the scan signal.

According to one or more embodiments, the pixel circuit further includes a gate initializing transistor to transmit an initializing voltage to the first node in response to a gate initializing signal.

According to one or more embodiments, the gate initializing transistor includes a pair of transistors which are simultaneously turned on according to the gate initializing signal and which are connected in series.

According to one or more embodiments, the pixel circuit further includes an anode initializing transistor to transmit an initializing voltage to an anode of the OLED in response to an anode initializing signal.

According to one or more embodiments, the pixel circuit further includes an emission control transistor to transmit a first driving voltage to a source of the driving transistor in response to an emission control signal.

According to one or more embodiments, the pixel circuit further includes an emission control transistor to connect a drain of the driving transistor to an anode of the OLED in response to an emission control signal.

Another aspect is a pixel circuit that includes an OLED, a driving transistor including a gate connected to a first node and supplying a driving current to the OLED according to a voltage of the gate, a storage capacitor connected to the first node, a diode unit connected to the first node, and a switching transistor connected to the first node through the diode unit and controlled by a first control signal.

According to one or more embodiments, the diode unit includes a first electrode connected to the switching transistor and a second electrode connected to the first node, and the diode unit may be turned on when a voltage of the first electrode is higher than a voltage of the second electrode by an absolute value of a first threshold voltage.

According to one or more embodiments, the absolute value of the first threshold voltage is less than an absolute value of a threshold voltage of the driving transistor.

According to one or more embodiments, the diode unit is a diode-connected transistor including a drain and a gate, which are commonly connected to the first node, and a source, which is connected to the switching transistor.

According to one or more embodiments, the switching transistor may include a pair of transistors which are simultaneously turned on according to the first control signal and which are connected in series.

Another aspect is an OLED display that includes a display panel comprising a plurality of pixels each including an OLED, a driving transistor including a gate connected to a first node and supplying a driving current to the OLED according to a voltage of the gate, a storage capacitor connected to the first node, a compensating transistor connected between the first node and a drain of the driving transistor and controlled by a first control signal, and a diode-connected transistor connected between the first node and the compensating transistor.

According to one or more embodiments, an absolute value of a threshold voltage of the driving transistor is greater than an absolute value of a threshold voltage of the diode-connected transistor.

According to one or more embodiments, the compensating transistor includes a pair of transistors which are simultaneously turned on according to the first control signal and which are connected in series.

According to one or more embodiments, the each pixel includes a scan transistor to transmit a data voltage to a source of the driving transistor in response to the first control signal, a gate initializing transistor to transmit an initializing voltage to the first node in response to a second control signal, a first emission control transistor to transmit a first driving voltage to a source of the driving transistor in response to a third control signal, and a second emission control transistor to connect a drain of the driving transistor to an anode of the OLED in response to the third control signal.

According to one or more embodiments, the each pixel includes an anode initializing transistor to transmit an initializing voltage to an anode of the OLED in response to a fourth control signal.

Another aspect is a pixel circuit comprising: an organic light-emitting diode (OLED); a driving transistor including a drain electrode and a gate electrode electrically connected to a first node, wherein the driving transistor is configured to supply a driving current to the OLED based on a voltage of the gate electrode; a storage capacitor electrically connected to the first node; a compensating transistor electrically connected between the first node and the drain electrode of the driving transistor and configured to be controlled by a scan signal; and a diode unit electrically connected between the first node and the compensating transistor, wherein the compensating transistor is electrically connected to the first node via the diode unit.

In the above pixel circuit, the absolute value of a threshold voltage of the driving transistor is greater than the absolute value of a threshold voltage of the diode unit.

In the above pixel circuit, the diode unit includes a diode-connected transistor comprising a drain electrode and a gate electrode, which are commonly connected to the first node, and a source electrode, which is connected to the compensating transistor.

In the above pixel circuit, the compensating transistor comprises a pair of transistors that are connected in series and configured to be simultaneously turned on based on the scan signal.

The above pixel circuit further comprises a scan transistor configured to transmit a data voltage to a source electrode of the driving transistor in response to the scan signal.

The above pixel circuit further comprises a gate initializing transistor configured to transmit an initializing voltage to the first node in response to a gate initializing signal.

In the above pixel circuit, the gate initializing transistor comprises a pair of transistors connected in series and configured to be simultaneously turned on according to the gate initializing signal.

The above pixel circuit further comprises an anode initializing transistor configured to transmit an initializing voltage to an anode electrode of the OLED in response to an anode initializing signal.

The above pixel circuit further comprises an emission control transistor configured to transmit a first driving voltage to a source electrode of the driving transistor in response to an emission control signal.

The above pixel circuit further comprises an emission control transistor configured to electrically connect a drain electrode of the driving transistor to an anode electrode of the OLED in response to an emission control signal.

A pixel circuit comprising: an organic light-emitting diode (OLED); a driving transistor including a gate electrode electrically connected to a first node and configured to supply a driving current to the OLED based on a voltage of the gate electrode; a storage capacitor connected to the first node; a diode unit connected to the first node; and a switching transistor electrically connected to the first node through the diode unit and configured to be controlled by a first control signal.

In the above pixel circuit, the diode unit comprises a first electrode electrically connected to the switching transistor and a second electrode electrically connected to the first node, wherein the diode unit is configured to be turned on when a voltage of the first electrode is greater than a voltage of the second electrode by the absolute value of a first threshold voltage.

In the above pixel circuit, the absolute value of the first threshold voltage is less than the absolute value of a threshold voltage of the driving transistor.

In the above pixel circuit, the diode unit includes a diode-connected transistor comprising a drain electrode and a gate electrode, which are commonly electrically connected to the first node, and a source electrode, which is connected to the switching transistor.

In the above pixel circuit, the switching transistor comprises a pair of transistors connected in series and configured to be simultaneously turned on according to the first control signal.

An organic light-emitting diode (OLED) display comprising: a display panel comprising a plurality of pixels. Each pixel comprises: an OLED; a driving transistor including a drain electrode and a gate electrode electrically connected to a first node and configured to supply a driving current to the OLED according to a voltage of the gate electrode; a storage capacitor electrically connected to the first node; a compensating transistor electrically connected between the first node and the drain of the driving transistor, wherein the compensating transistor is configured to be controlled by a first control signal; and a diode-connected transistor electrically connected between the first node and the compensating transistor, wherein the compensating transistor is electrically connected to the first node via the diode unit.

In the above display, the absolute value of a threshold voltage of the driving transistor is greater than the absolute value of a threshold voltage of the diode-connected transistor.

In the above display, the compensating transistor comprises a pair of transistors connected in series and configured to be simultaneously turned on based on the first control signal.

In the above display, the each pixel comprises: a scan transistor configured to transmit a data voltage to a source electrode of the driving transistor in response to the first control signal; a gate initializing transistor configured to transmit an initializing voltage to the first node in response to a second control signal; a first emission control transistor configured to transmit a first driving voltage to a source electrode of the driving transistor in response to a third control signal; and a second emission control transistor configured to electrically connect a drain electrode of the driving transistor to an anode electrode of the OLED in response to the third control signal.

In the above display, each of the pixels comprises an anode initializing transistor configured to transmit an initializing voltage to an anode electrode of the OLED in response to a fourth control signal.

DETAILED DESCRIPTION OF CERTAIN INVENTIVE EMBODIMENTS

Figure 1:
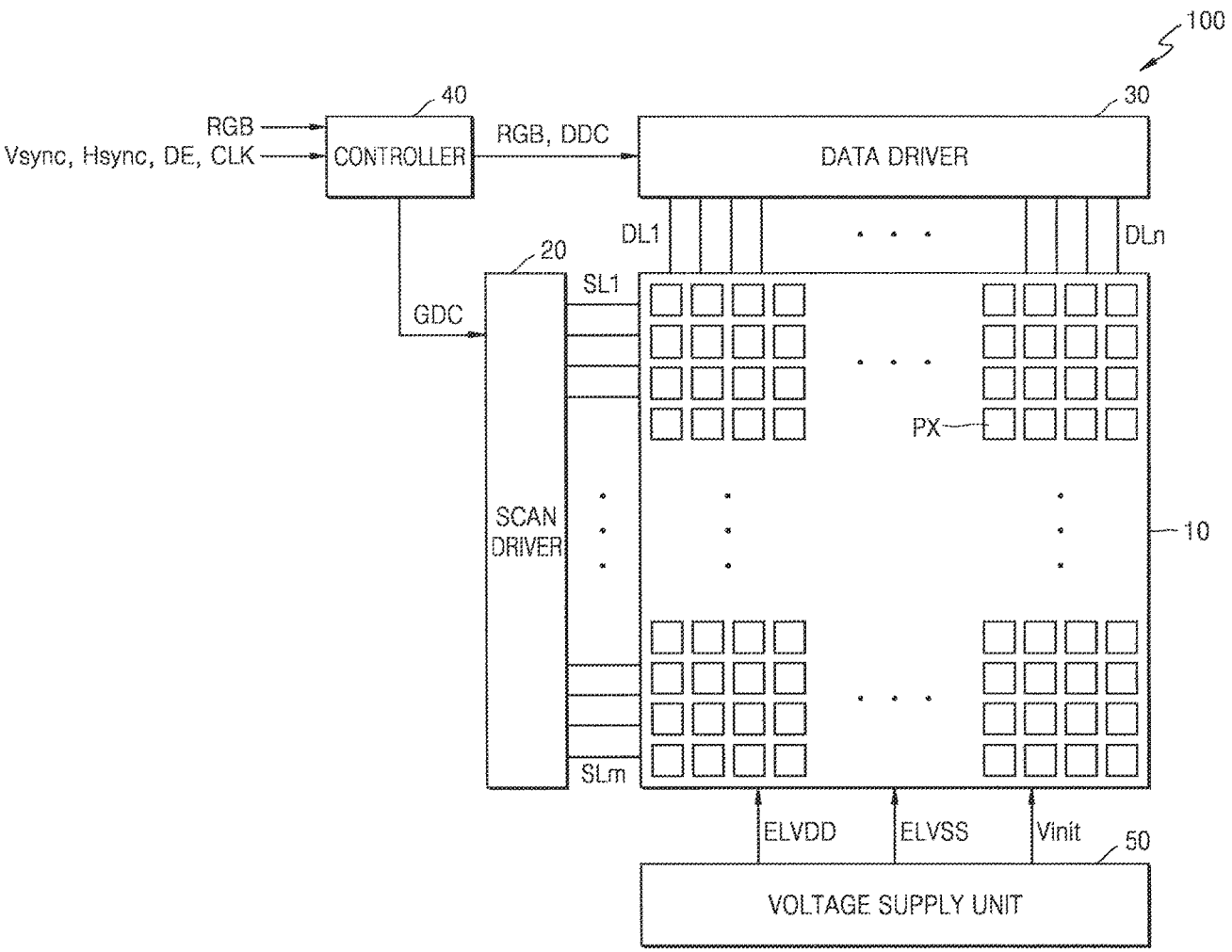
FIG. 1 is a block diagram schematically illustrating an OLED display according to an embodiment.

Reference will now be made in detail to embodiments, examples of which are illustrated in the accompanying drawings, wherein like reference numerals refer to like elements throughout. In this regard, the present embodiments may have different forms and should not be construed as being limited to the descriptions set forth herein. Accordingly, the embodiments are merely described below, by referring to the figures, to explain aspects of the present description.

It will be understood that although the terms "first", "second", etc. may be used herein to describe various components, these components should not be limited by these terms. These components are only used to distinguish one component from another. As used herein, the singular forms "a," "an" and "the" are intended to include the plural forms as well, unless the context clearly indicates otherwise.

As used herein, the term "and/or" includes any and all combinations of one or more of the associated listed items. Expressions such as "at least one of," when preceding a list of elements, modify the entire list of elements and do not modify the individual elements of the list.

Reference will now be made in detail to embodiments, examples of which are illustrated in the accompanying drawings, wherein like reference numerals refer to like elements throughout. In this disclosure, the term "substantially" includes the meanings of completely, almost completely or to any significant degree under some applications and in accordance with those skilled in the art. Moreover, "formed, disposed or positioned over" can also mean "formed, disposed or positioned on." The term "connected" includes an electrical connection.

FIG. 1 is a block diagram schematically illustrating an OLED display 100 according to an embodiment. Depending on embodiments, certain elements may be removed from or additional elements may be added to the OLED display 100 illustrated in FIG. 1. Furthermore, two or more elements may be combined into a single element, or a single element may be realized as multiple elements. This also applies to the remaining disclosed embodiments.

Referring to FIG. 1, the OLED display 100 includes a display 10, a scan driver 20, a data driver 30, a controller 40, and a voltage supply unit 50.

The display 10 includes a plurality of pixels PXs, which are arranged in a matrix form. The pixel PX includes an OLED, a driving transistor having a gate connected to a first node of the pixel PX and supplying a driving current to the OLED according to a voltage of the gate, a storage capacitor connected to the first node, a diode connected to the first node, and a switching transistor connected to the first node and being controlled by a first control signal.

The pixel PX is connected to a corresponding scan line among scan lines SL1 through SLm and is also connected to a corresponding data line among data lines DL1 through DLn. The scan lines SL1 through SLm respectively transmit control signals, which are output from the scan driver 20, to the same column of the pixels PXs, and the data lines DL1 through SLn respectively transmit data voltages, which are output from the data driver 30, to the same row of the pixels. Although a single line is illustrated as each of the scan lines SL1 through SLm in FIG. 1, a plurality of lines may be included in each of the scan lines SL1 through SLm to transmit a plurality of controls signals in parallel according to the pixel PX.

The voltage supply unit 50 supplies a first driving voltage ELVDD, a second driving voltage ELVSS, and an initializing voltage Vinit to the pixel PX. The first driving voltage ELVDD and the second driving voltage ELVSS are each a driving voltage to drive the OLED of the pixel PX to emit light. The first driving voltage ELVDD may have a level higher than a level of the second driving voltage ELVSS. The initializing voltage Vinit may be usable to perform an operation of the pixel PX and may have a voltage level similar to the second driving voltage ELVSS. In another embodiment, the initializing voltage Vinit has a voltage level similar to the first driving voltage ELVDD according to a pixel circuit and a conductive type of a transistor of the pixel PX.

The pixel PX may control the amount of a current flowing through the OLED from the first voltage ELVDD to the second voltage ELVSS according to the data voltage transmitted through a corresponding one of the data lines DL1 through DLn. The data voltage is referred to as a signal or a voltage level which is transmitted through a corresponding one of the data lines DL1 through DLn. The OLED of the pixel PX emits light having luminance corresponding to the data voltage. Although the pixel PX may correspond to a sub-pixel, for example, a portion of a pixel which displays a full color, the sub-pixel is explained as the pixel for convenience.

The controller 40 may receive a vertical synchronization signal Vsync, a horizontal synchronization signal Hsync, a data enable signal DE, a clock signal CLK, and a data signal RGB. The controller 40 controls operation timings of the scan driver 20 and the data driver 30 according to timing signals, such as the vertical synchronization signal Vsync, the horizontal synchronization signal Hsync, the data enable signal DE, and the clock signal CLK. Since the controller 40 may determine a period of a frame by counting the data enable signal DE within a horizontal scanning period, the vertical synchronization signal Vsync and the horizontal synchronization signal Hsync, which are transmitted from outside, may be omitted. The data signal RGB may include information on the luminance of the respective pixels PXs. The luminance may have a predetermined number of gray levels, for example, 1024 ($=2^{10}$), 256 ($=2^{8}$), or 64 ($=2^{6}$).

The controller 40 may generate a gate timing control signal GDC to control the operation timing of the scan driver 20 and a data timing control signal DDC to control the operation timing of the data driver 30.

The gate timing control signal GDC may include signals, such as a gate start pulse (GSP) signal, a gate shift clock (GSC) signal, and a gate output enable (GOE) signal. The gate start pulse (GSP) signal is supplied to the scan driver 20 to generate a first scan signal. The GSC signal is a clock signal commonly supplied to the scan driver 20 to shift the GSP signal. The GOE signal controls an output of the scan driver 20.

The data timing control signal DDC may include signals, such as a source start pulse (SSP) signal, a source sampling clock (SSC) signal, and a source output enable (SOE) signal. The SSP signal controls a starting point of data sampling of the data driver 30. The source sampling pulse (SSP) signal is a clock signal to control the operation timing of the data sampling of the data driver 30 according to a rising or falling edge thereof. The SOE signal controls an output of the data driver 30. The SSP signal, which is supplied to the data driver 30, may be omitted according to a data transmission method.

The scan driver 20 may sequentially generate control signals to operate transistors of the pixel PX, in the display 10, in response to the gate timing control (GTC) signal which is supplied from the controller 40. The scan driver 20 supplies the control signals the pixels PXs of the display 10 through the scan lines SL1 through SLm. According to a design preference of the pixel PX, control signals may be supplied to the pixel PX. For example, first through fourth control signals are supplied to the pixel PX during a frame in a sequential order.

The data driver 30 samples and latches a data signal RGB of a digital signal type, which is supplied from the controller 40, in response to the data timing control signal DDC which is supplied from the controller 40, and converts the sampled and latched signal into data of a parallel data system. When data is converted into parallel data in the data driver 30, the data signal RGB of the digital signal type is converted into a gamma-based voltage and then converted into the data voltage of an analog signal type. The data driver 30 supplies data voltages to the pixels PXs of the display 10 through the data lines DL1 through DLn.

The pixels PXs according to various embodiments will be explained in detail hereinafter.

Figure 2:
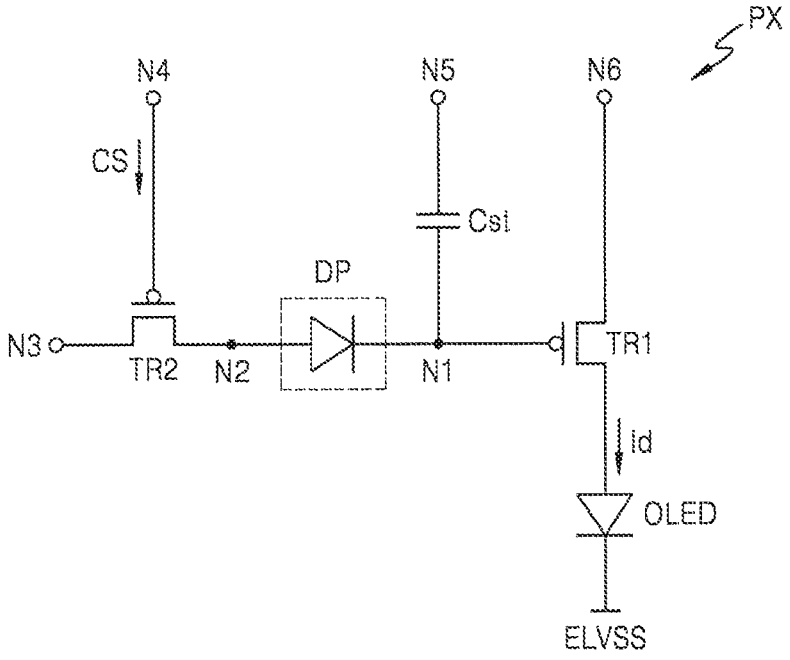
FIG. 2 is a circuit diagram schematically illustrating a pixel according to an embodiment.

FIG. 2 is a circuit diagram schematically illustrating a pixel PX according to an embodiment.

Referring to FIG. 2, the pixel PX includes an OLED, first and second transistors TR1 and TR2, a storage capacitor Cst, and a diode (or diode unit or unidirectional circuit) DP.

The first transistor TR1 includes a gate connected to a first node N1 and supplies a driving current Id to the OLED according to a gate voltage of the gate of the first transistor TR1. Although the amount of the driving current Id is determined according to a gate-source voltage of the first transistor TR1, the amount of the driving current Id may be controlled by the gate voltage of the first transistor TR1 when a source voltage of the first transistor TR1 is fixed. The first transistor TR1 may be referred to as a driving transistor. The first transistor TR1 may include a drain connected to an anode of the OLED and a source connected to a sixth node N6. The first driving voltage ELVDD may be supplied to the sixth node N6.

The storage capacitor Cst is connected between the first node N1 and a fifth node N5, and maintains the gate voltage of the first transistor TR1, that is, a voltage of the first node N1. The storage capacitor Cst may maintain the gate voltage of the first transistor TR1 during a period of a frame, for example, during an emission period after a data programming period. As a result, the first transistor TR1 may supply constant driving current Id to the OLED for the emission period, and the OLED emits light having constant luminance. The fifth node N5 may be connected to the source of the first transistor TR1, that is, the sixth node N6. The level of the first driving voltage ELVDD applied to the fifth node N5 may be constant.

The second transistor TR2 may be connected between a second node N2 and a third node N3 and may be controlled by a control signal CS, which is supplied through a fourth node N4. In another embodiment, the second transistor TR2 includes a pair of transistors which are substantially simultaneously (or concurrently) controlled by the control signal CS and connected in series. The second transistor TR2 may be referred to as a switching transistor.

As illustrated in FIG. 2, the second transistor TR2 is a p-type metal-oxide-semiconductor field-effect transistor (p-type MOSFET). The second transistor TR2 turns off when receiving a high level of the control signal CS through the fourth node N4, and turns on when receiving a low level of the control signal CS through the fourth node N4. Here, the high level is referred to as a turn-off level, and the low level is referred to as a turn-on level. However, the described technology is not limited thereto. The second transistor TR2 may be an n-type metal-oxide-semiconductor field-effect transistor (n-type MOSFET). Hereinafter, a case in which the second transistor TR2 is a p-type MOSFET is explained as an example.

At a rising edge of the control signal CS, the second transistor TR2 becomes turned off. There may be a parasitic capacitance Cp between a gate and a drain area (that is, the second node N2) of the second transistor TR2 of the p-type MOSFET. Accordingly, at the rising edge of the control signal CS, a voltage of the second node N2 may rise by being capacitance-coupled to the rising edge of the control signal CS.

When there is no diode DP, that is, when the second node N2 is directly connected to the first node N1, which is a gate of the first transistor TR1, there is parasitic capacitance Cp between the gate of the second transistor TR2 and the gate of the first transistor TR1. The voltage of the first node N1 is maintained by the storage capacitor Cst. As a size of the pixel PX decreases, an area and a capacitance of the storage capacitor Cst decrease. Accordingly, a ratio of the parasitic capacitance Cp of the second transistor TR2 with respect to the capacitance of the storage capacitor Cst increases.

The control signal CS is a signal to control the second transistor TR2 and has a variable voltage range of about 20 V. In response to the rising edge of the control signal CS, an increased amount of the voltage of the first node N1 is proportional to the ratio of the parasitic capacitance Cp of the second transistor TR2 with respect to the capacitance of the storage capacitor Cst. The voltage of the first node N1 is additionally increased by the rising edge of the control signal CS. The additionally increased gate voltage may be referred to as a kickback voltage. The driving current Id, which is output from the first transistor TR1, is decreased by the kickback voltage. Accordingly, the luminance of the OLED may be lowered.

When the pixel does not include the diode DP, the kickback voltage may be compensated by lowering the data voltage by the amount of the kickback voltage if the kickback voltage, which corresponds to a variable voltage range of the first node N1 and may be increased according to the rising edge of the control signal CS, keeps constant. However, when a threshold voltage of the second transistor TR2 is changed, the parasitic capacitance Cp between the gate of the second transistor TR2 and the gate of the first transistor TR1 is changed, and accordingly, the amount of the kickback voltage is also changed. For example, when a channel length of the second transistor TR2 is shortened due to degradation, for example, an absolute value of the threshold voltage of the second transistor TR2 decreases, and the parasitic capacitance Cp is increased.

When the absolute value of the threshold voltage of the second transistor TR2 decreases, the parasitic capacitance Cp between the gate of the second transistor TR2 and the gate of the second transistor TR1 increases and the kickback voltage also increases. The driving current Id is decreased more, and the luminance of the OLED is lowered. As such, since a variance of the threshold voltage of the second transistor TR2 may be changeable according to a location of the pixel PX within a display panel of a display, it is difficult to compensate for the change of the variance of the threshold voltage of the second transistor TR2.

According to the present embodiment, the diode DP is connected between the second node N2 and the first node N1. The diode DP may have a first terminal electrode, such as a cathode which is connected to the first node N1, and a second terminal electrode, such as an anode which is connected to the second node N2. The diode DP may be turned on when a voltage of the second terminal is higher than a voltage of the first terminal by a threshold voltage thereof. Accordingly, the diode DP transmits a current flowing in a direction from the second node N2 to the first node N1 and blocks a current flowing in an opposite direction. Therefore, the diode DP may be arranged on a path, in which a current flows therethrough in a single direction, among paths connected to the first node N1 corresponding to the gate of the first transistor TR1. Although not illustrated in FIG. 2, an initializing circuit may be additionally connected to the pixel PX and may initialize a voltage of the first node N1 to a lower level voltage in an initial stage of every frame, so that the current flows from the second node N2 to the first node N1.

In another embodiment, the diode DP is connected in an opposite direction. For example, when the first transistor is an n-type MOSFET, the anode of the diode DP is connected to the first node N1 and the cathode of the diode DP may be connected to the second node N2. In this case, the initializing circuit may be connected to the pixel PX so that the voltage of the first node N1 is initialized to a higher level voltage at the initial stage of every frame.

According to an embodiment, when the diode DP is between the second node N2 and the first node N1, and when the control signal CS has a rising edge, the voltage of the first node N1 may not be changed or the voltage variable range of the first node N1 may be reduced although the voltage of the second node N2 is not changed. Since the second node N2 and the first node N1 are not directly connected to each other, but connected through the diode DP, the gate of the second transistor TR2 and the gate of the first transistor TR1 are not in direct capacitance-coupling.

Moreover, although the kickback voltage which occurs at the second node N2 may be changed according to a change of the threshold voltage of the second transistor TR2, the amount of the kickback voltage which occurs at the second node N2 may be at least reduced or the kickback voltage may be removed since there is no direct capacitance-coupling between the gate of the second transistor TR2 and the gate of the first transistor TR1.

According to a simulation result, in a case in which the diode DP is not in the pixel PX, when the absolute value of the threshold voltage of the second transistor TR2 is reduced by about 1 corresponding to about 1 V, for example, the luminance of the OLED is reduced by about 15%. In a case in which the diode DP is disposed between the second node N2 and the first node N1 in the pixel PX according to the present embodiment, the luminance of the OLED is reduced by about 2.5% through about 4.5% although the threshold voltage of the second transistor TR2 is reduced by about 1 corresponding to about 1 V, for example. Moreover, in a case in which the diode DP is not in the pixel PX, when the absolute value of the threshold voltage of the second transistor TR2 is reduced by about 2 corresponding to about 2 V, for example, the luminance of the OLED is reduced by about 25% through about 30%. However, in a case in which the diode DP is disposed between the second node N2 and the first node N1 in the pixel PX according to the present embodiment, the luminance of the OLED is reduced by about 3% through about 5% although the absolute value of the threshold voltage of the second transistor TR2 is reduced by about 2 corresponding to about 2 V, for example.

In an embodiment, the third node N3 is connected to a drain of the first transistor TR1 so that the second transistor TR2 may form a diode-connection with the first transistor TR1 to compensate for a threshold voltage of the first transistor TR1. In this case, an initializing circuit may be connected to the first node N1 to supply a predetermined initializing voltage to the first node N1. The initializing voltage may have a voltage level similar to one of the first driving voltage ELVDD or the second driving voltage ELVSS according to a conductive type of the first transistor TR1 and a connection direction of the diode DP.

In another embodiment, the third node N3 is connected to the data line to transmit a data voltage, and the second transistor (or scan transistor) TR3 may transmit the data voltage to the first node N1 in response to the control signal CS. In this case, an initializing circuit may be connected to the first node N1 to supply a predetermined voltage level to the first node 1. The initializing voltage may have a voltage level similar to one of the first driving voltage ELVDD or the second driving voltage ELVSS according to a conductive type of the first transistor TR1 and a connection direction of the diode DP.

Figure 3:
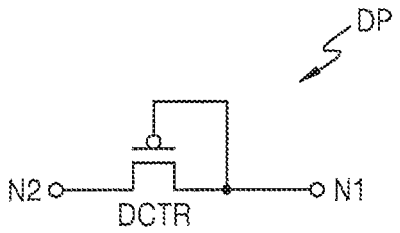
FIG. 3 is a circuit diagram schematically illustrating a diode of FIG. 2.

FIG. 3 is a circuit diagram schematically illustrating the diode DP of FIG. 2

Referring to FIG. 3, the diode DP includes a diode-connected transistor DCTR in which a gate of the diode DP and a gate of the diode DP are connected to each other. When the diode-connected transistor DCTR is a p-type MOSFET, a gate of the diode-connected transistor DCTR may be connected to the first node N1 so that a direction from the second node N2 to the first node N1 is a forward direction. The diode-connected transistor DCTR is turned on when a voltage of the second node N2 is higher than a voltage of the first node N1 by an absolute value of a threshold voltage of the diode-connected transistor DCTR.

In another embodiment, when the diode-connected transistor DCTR is an n-type MOSFET, a gate of the diode-connected transistor DCTR may be connected to the second node N1 so that a direction from the second node N2 to the first node N1 is a forward direction. A conductive type of the diode-connected transistor DCTR may be the same as a conductive type of the second transistor TR2.

Figure 4A:
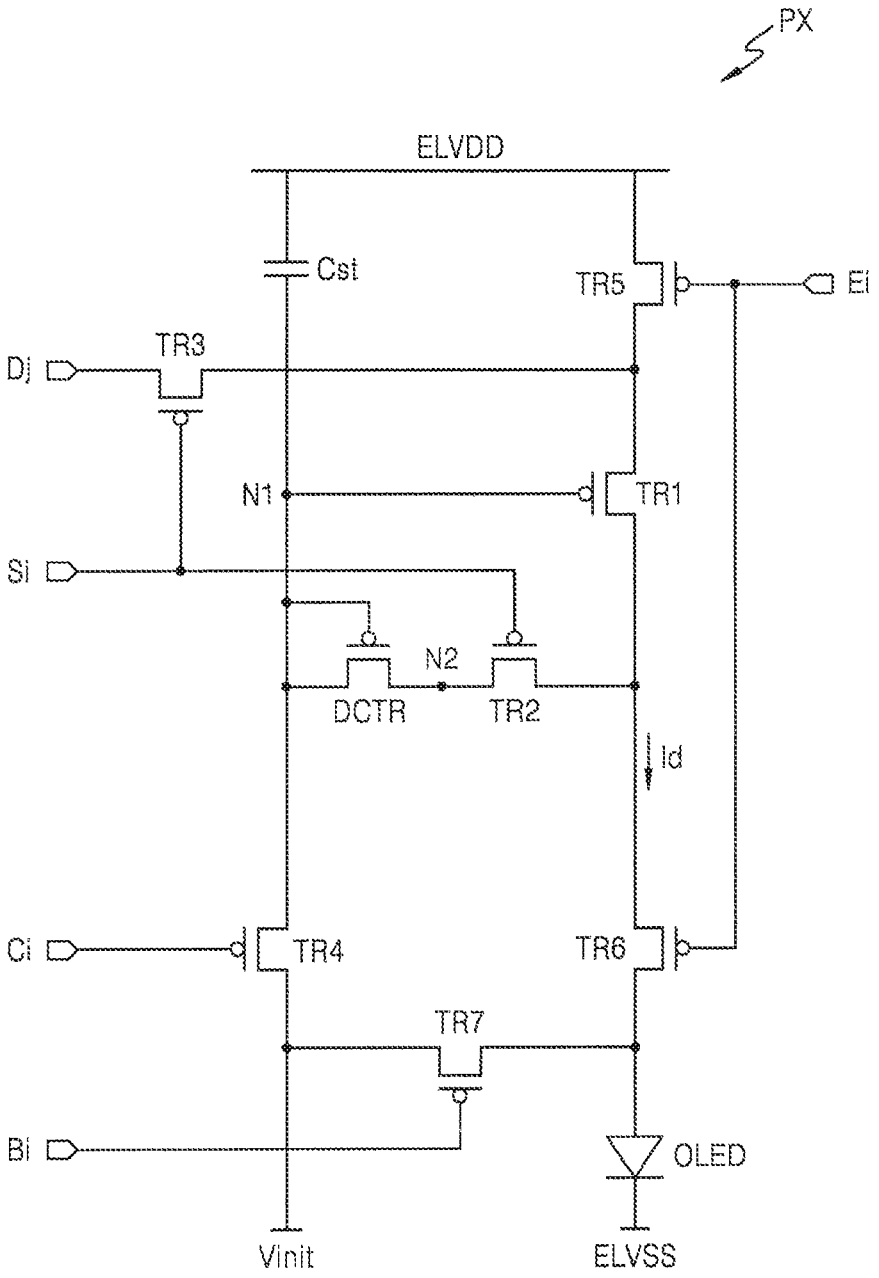
FIG. 4A is a circuit diagram illustrating a pixel according to another embodiment.
Figure 4B:
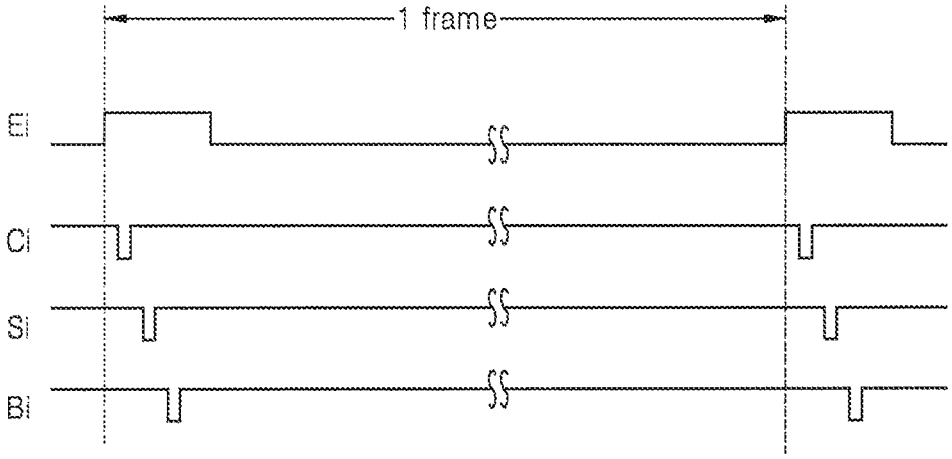
FIG. 4B is a timing diagram of the pixel of FIG. 4A.

FIG. 4A is a circuit diagram illustrating a pixel PX according to another embodiment, and FIG. 4B is a timing diagram of the pixel PX of FIG. 4A.

Referring to FIGS. 4A and 4B, the pixel PX includes an OLED, first through seven transistors TR1 through TR7, a storage capacitor Cst, and a diode-connected transistor DCTR.

The first transistor TR1 includes a gate which is connected to a first node N1, a source to which a first driving voltage ELVDD is supplied through the fifth transistor TR5, and a drain which is connected to an anode of the OLED through the sixth transistor TR6. The first transistor TR1 supplies a driving current Id to the OLED according to a voltage of the gate of the first transistor TR1. The amount of the driving current Id may be controlled by the gate voltage of the first transistor TR1. The first transistor TR1 may be referred to as a driving transistor.

The storage capacitor Cst includes a first electrode, which is connected to a first node N1, and a second electrode, to which a first driving voltage ELVDD is applied, and maintains a gate voltage of the first transistor TR1 constant. Because the first driving voltage ELVDD is applied to the source of the first transistor TR1 through the fifth transistor TR5, the fifth transistor TR5 is turned on during an emission period after a data programming period, and then the storage capacitor Cst may maintain a gate-source voltage of the first transistor TR1 constant.

The third transistor TR3 is connected between a data line, which transmits a data voltage Dj, and the source of the first transistor TR1. The third transistor TR3 is controlled by a first control signal Si. The first control signal Si is transmitted through a scan line. The third transistor TR3 transmits a data voltage Dj to the source of the first transistor TR1 in response to the first control signal Si. The third transistor TR3 may be referred to as a switching transistor.

The diode-connected transistor DCTR is connected between the first node N1 and a second node N2. The diode-connected transistor DCTR includes a gate and a drain, which are commonly connected to each other, and a source, which is connected to the second node N2. When a voltage of the second node N2 is higher than a voltage of the first node N1 by an absolute value of a threshold voltage of the diode-connected transistor DCTR, the diode-connected transistor DCTR is turned on.

The second transistor TR2 is connected between the second node N2 and the drain of the first transistor TR1. The second transistor TR2 is connected to the first node N1 through the diode-connected transistor DCTR. The second transistor TR2 is controlled by the first control signal Si. The second transistor TR2 is diode-connected to the first transistor TR1 by electrically connecting the gate and the drain of the first transistor TR1 through the diode-connected transistor DCTR in response to the first control signal Si. The second transistor TR2 is diode-connected to the first transistor TR1 so that a compensating voltage, in which a threshold voltage of the first transistor TR1 is compensated, is stored in the storage capacitor Cst. The second transistor TR2 may be referred to as a compensating transistor.

When the first control signal Si has a turn-on level, that is a low level, the second transistor TR2 and the third transistor TR3 are turned on. The data voltage Dj is transmitted to the source of the first transistor TR1 through the third transistor TR3. Here, the fifth transistor TR5 is turned off. The first transistor TR1 is diode-connected to the second transistor TR2, and the first transistor TR1 and the second transistor TR2 are in a forward bias state. As a result, a compensating voltage Dj+Vth, in which a threshold voltage Vth, that is a negative voltage Vth, is reflected to the data voltage Dj, is applied to the first node N1.

When the compensating voltage Dj+Vth is applied to the first electrode of the storage capacitor Cst, and the first driving voltage ELVDD is applied to the second electrode of the storage capacitor Cst, the fifth transistor TR5 is turned on, and a gate-source voltage of the first transistor TR1 becomes a voltage of Dj+Vth-ELVDD. During the emission period, the fifth transistor TR5 is turned on, and then the driving current Id, which is output from the first transistor TR1, may be a square of a value in which the threshold voltage Vth is subtracted from the gate-source voltage of Dj+Vth-ELVDD, that is, may be a value which is proportional to (Dj−ELVDD). That is, the driving current Id may be output regardless of the threshold voltage Vth of the first transistor TR1.

The fourth transistor TR4 supplies an initializing voltage Vinit to the first node N1 in response to a second control signal Ci. When the initializing voltage Vinit is supplied to the first node N1, the first transistor TR1 is full-turned on. The initializing voltage Vinit is set to a voltage to full-turn on the first transistor TR1. The fourth transistor TR4 may be referred to as a gate initializing transistor.

The fifth transistor TR5 supplies the first driving voltage ELVDD to the source of the first transistor TR1 in response to a third control signal Ei. When the first driving voltage ELVDD is applied to the fifth transistor TR5, the first transistor TR1 outputs the driving current Id corresponding to the gate-source voltage through the drain of the first transistor TR1.

The sixth transistor TR6 connects the drain of the first transistor TR1 to an anode of the OLED in response to the third control signal Ei. The driving current Id which is output from the drain of the first transistor TR1 is provided to the OLED, and then the OLED emits light having the luminance according to the driving current Id. The fifth and sixth transistors TR5 and TR6 may be referred to as an emission control transistor.

The seventh transistor TR7 supplies the initializing voltage to the anode of the OLED in response to a fourth control signal Bi. When the initializing voltage is supplied to the anode of the OLED, the OLED is turned off and does not emit light. A difference between the initializing voltage Vinit and the second driving voltage ELVSS is lower than a threshold voltage of the OLED, so that the OLED is turned off. The seventh transistor TR7 may be referred to as an anode initializing transistor.

According to another embodiment, the seventh transistor TR7 may be omitted. According to another embodiment, the seventh transistor TR7 may be controlled by the second control signal Ci.

As illustrated in FIG. 4A, the first through seventh transistors TR1 through TR7 and the diode-connected transistor DCTR may be a p-type MOSFET. However, the described technology is not limited thereto. At least one of the first through seventh transistors TR1 through TR7 and the diode-connected transistor DCTR may be an n-type MOSFET.

FIG. 4B illustrates a timing chart of the first through fourth control signals Si, Ci, Ei, and Bi within a frame. As illustrated in FIG. 4A, it is assumed that the first through seventh transistors TR1 through TR7 and the diode-connected transistor DCTR are the p-type MOSFET.

When the third control signal Ei is changed to a turn-off level (high level), the second control signal Ci, the first control signal Si, and the fourth control signal Bi sequentially have a turn-on level period. When the fourth control signal Bi is changed to the turn-off level (high level), the third control signal Ei is changed to the turn-on level (low level).

During the turn-off level of the third control signal Ei, the fifth and sixth transistors TR5 and TR6 are turned off according to the third control signal Ei. The first driving voltage ELVDD is not supplied to the first transistor TR1, and it is in an open state between the first transistor TR1 and the OLED, so that the OLED does not emit light. A turn-off period of the third control signal Ei may be referred to a non-emission period. Contrarily, a turn-on period of the third control signal Ei may be referred to an emission period.

During the turn-on level of the second control signal Ci, the fourth transistor TR4 is turned on according to the second control signal Ci. When the initializing voltage Vinit is supplied to the gate of the first transistor TR1, the first transistor TR1 is full-turned on. Whenever the first transistor TR1 is full-turned on in every frame, an inappropriate color expression may be improved by a hysteresis characteristic of the first transistor TR1. The turn-on period of the second control signal Ci may be referred to as a gate initializing period.

During the turn-on level of the first control signal Si, the second and third transistors TR2 and TR3 are turned on in response to the second control signal Si. The data voltage Dj is supplied to the source of the first transistor TR1 through the third transistor TR3. Since the voltage of the first node N1 is lowered to the initial voltage Vinit, a voltage level of the second node N2 is higher than a voltage level of the first node N1, the diode-connected transistor DCTR is turned on in the forward bias state. The first transistor TR1 is in a diode-connection through the diode-connected transistor DCTR and the second transistor TR2. A compensating voltage of Dj+Vth, in which the threshold voltage Vth of the first transistor TR1 is added to the data voltage Dj, is supplied to the first node N1, and the compensating voltage of Dj+Vth is stored in the first electrode of the storage capacitor Cst. The turn-on level period of the first control signal Si may be referred to as the data programming period. The threshold voltage Vth of the first transistor TR1 may be compensated according to a circuit operation of the data programming period.

When the first control signal Si is changed to a turn-off level, the first control signal Si has a rising edge. Since there is parasitic capacitance between the gate and the drain of the second transistor TR2, the voltage of the second node N2 increases in response to the rising edge of the first control signal Si. However, since the diode-connected transistor DCTR is connected between the first node N1 and the second node N2, the gate of the second transistor TR2 is not capacitance-coupled to the gate of the first transistor TR1, and then the voltage of the first node N1 does not increase or an increased amount of the voltage of the first node N1 is reduced, in response to the rising edge of the first control signal Si. Accordingly, a threshold voltage of the second transistor TR2 is changed, or the voltage of the first node N1 is maintained stable even if the parasitic capacitance between the gate and the drain of the second transistor TR2 is changed.

During a turn-on level of the fourth control signal Bi, the seventh transistor TR7 is turned on according to the fourth control signal Bi. The initializing voltage Vinit is supplied to the anode of the OLED by the seventh transistor TR7, and the OLED is turned off. The turn-on level period of the fourth control signal Bi may be referred to as an anode initializing period.

During the non-emission period, the gate initializing period, the data programming period, and the anode initializing period are sequentially operated. In the emission period, the first transistor TR1 provides the OLED with the driving current Id, which corresponds to the data voltage Dj, according to the compensating voltage of Dj+Vth which is stored in the storage capacitor Cst such that the OLED emits light of the luminance corresponding to the data voltage Dj.

The data programming period will be explained in more detail hereinafter.

The second transistor TR2 is turned off according to the rising edge of the first control signal Si. There is parasitic capacitance between the gate and the drain (that is, the second node N2) of the second transistor TR2. Accordingly, when the first control signal Si has a rising edge, the voltage of the second node N2 increases according to the capacitance-coupling to the rising edge of the first control signal Si. As such, the voltage of the second node N2, which increases according to the capacitance-coupling to the rising edge of the first control signal Si, may be referred to as a kickback voltage.

When there is no diode-connected transistor DCTR, that is, the second node N2 is directly connected to the first node N1, the second node N2 is directly connected to the gate of the first transistor TR1, and thus there is parasitic capacitance between the gate of the second transistor TR2 and the gate of the first transistor TR1. The first node N1 is connected to the storage capacitor Cst, and the voltage of the first node N1 is maintained by the storage capacitor Cst. The kickback voltage, which occurs at the first node N1 in response to the rising edge of the first control signal Si, is proportional to a ratio of the parasitic capacitance Cp of the second transistor TR2 with respect to the capacitance of the storage capacitor Cst.

As a size of the pixel PX becomes smaller, the capacitance of the storage capacitor Cst is gradually smaller, and the ratio of the parasitic capacitance Cp of the second transistor TR2 with respect to the capacitance of the storage capacitor Cst becomes gradually greater. The kickback voltage, which occurs at the first node N1, increases, and the driving current Id, which is output from the first transistor TR1, decreases. Accordingly, the luminance of the OLED may be lowered.

Even when there is no diode-connected transistor DCTR, that is, the second node N2 is directly connected to the first node N1, the kickback voltage may be compensated by lowering the data voltage Dj by the amount of the kickback voltage if the kickback voltage is constant, that is, if a variable amount of the voltage of the first node N1, which increases according to the rising edge of the first control signal Si, is constant. However, when the threshold voltage of the second transistor TR2 is changed, the parasitic capacitance between the gate of the second transistor TR2 and the gate of the first transistor TR1 becomes variable, and the amount of the kickback voltage is changed. For example, when a channel length of the second transistor TR2 is shortened due to degradation, an absolute value of the threshold voltage of the second transistor TR2 decreases and the parasitic capacitance increases.

When the absolute value of the threshold voltage of the second transistor TR2 is decreased, the parasitic capacitance between the gate of the second transistor TR2 and the gate of the first transistor TR1 is increased, and thus the amount of the kickback voltage is increased. The driving current Id is decreased, and thus the luminance of the OLED is lowered. Since the variance of the threshold voltage of the second transistor TR2 may be different from others according to locations within a display panel, it is more difficult to compensate for the variance the threshold voltage of the second transistor TR2.

According to the present embodiment, the diode-connected transistor DCTR is connected between the second node N2 and the first node N1. And thus, when the voltage of the second node N2 is changed in response to the rising edge of the first control signal Si, the voltage of the first node N1 may not be changed or a voltage change of the first node N1 may be reduced even if the voltage of the first node N1 is changed. Since the second node N2 and the first node N1 are not directly connected but connected through the diode-connected transistor DCTR, the gate of the second transistor TR2 and the gate of the first transistor TR1 are not directly capacitance-coupled to each other.

Moreover, as the threshold voltage of the second transistor TR2 is changed, the kickback voltage of the second node N2 may be changed. However, since the gate electrode of the second transistor TR2 and the gate of the first transistor TR1 are not directly capacitance-coupled to each other, the amount of the kickback voltage of the first node N1 may be reduced or a change of the kickback voltage of the first node N1 may be removed.

The threshold voltage of the first transistor TR1 is referred to as a first threshold voltage Vth1, which is a negative value, and a threshold voltage of the diode-connected transistor DCTR is referred to as a second threshold voltage Vth2, which is a negative value. It is assumed that all of the conductive types of the first transistor TR1 and the diode-connected transistor DCTR are the p-type MOSFET. In order to store the compensating voltage of Dj+Vth1, in which the first threshold voltage Vth1 of the first transistor TR1 is reflected to the data voltage Dj, in the first electrode of the storage capacitor Cst, the first threshold voltage Vth1 may be lower than the second threshold voltage Vth2. That is, an absolute value of the first threshold voltage Vth1 may be greater than an absolute value of the second threshold voltage Vth2.

The data voltage Dj is supplied to the source of the first transistor TR1 through the third transistor TR3. Here, the first transistor TR1 is turned off when the voltage of the first node N1, which is the gate of the first transistor TR1, is lower than the data voltage Dj, which is supplied to the source of the first transistor TR1, by the first threshold voltage Vth1. For example, when the voltage of the first node N1 is increased from the initializing voltage Vinit and becomes the same as the compensating voltage of Dj+Vth1, the first transistor TR1 is turned off. Since an absolute value IVth21 of the second threshold voltage Vth2, which is a threshold voltage of the diode-connected transistor DCTR, is less than an absolute value 1Vth11 of the first threshold voltage Vth1, the diode-connected transistor DCTR maintains the turn-off state until the voltage of the first node n1 becomes the same as the compensating voltage of Dj+Vth1.

If the absolute value 1Vth11 of the first threshold voltage Vth1 is less than the absolute value 1Vth21 of the second threshold voltage Vth2, the diode-connected transistor DCTR is turned off when the voltage of the first node N1 is increased from the initializing voltage and becomes the same as the compensating voltage of Dj+Vth2. That is, the diode-connected transistor DCTR is turned off before the first transistor TR1. Accordingly, the compensation voltage of Dj+Vth 2, in which the second threshold voltage Vth2 is reflected to the data voltage Dj, is stored in the first electrode of the storage capacitor Cst, and thus the voltage of the first transistor TR1 may not be compensated.

In another embodiment, when the transistors TR1 through TR3 and DCTR are the n-type MOSFET, the first threshold voltage Vth1 of the first transistor TR1 may be greater than the second threshold voltage of the diode-connected transistor DCTR.

Figure 5:
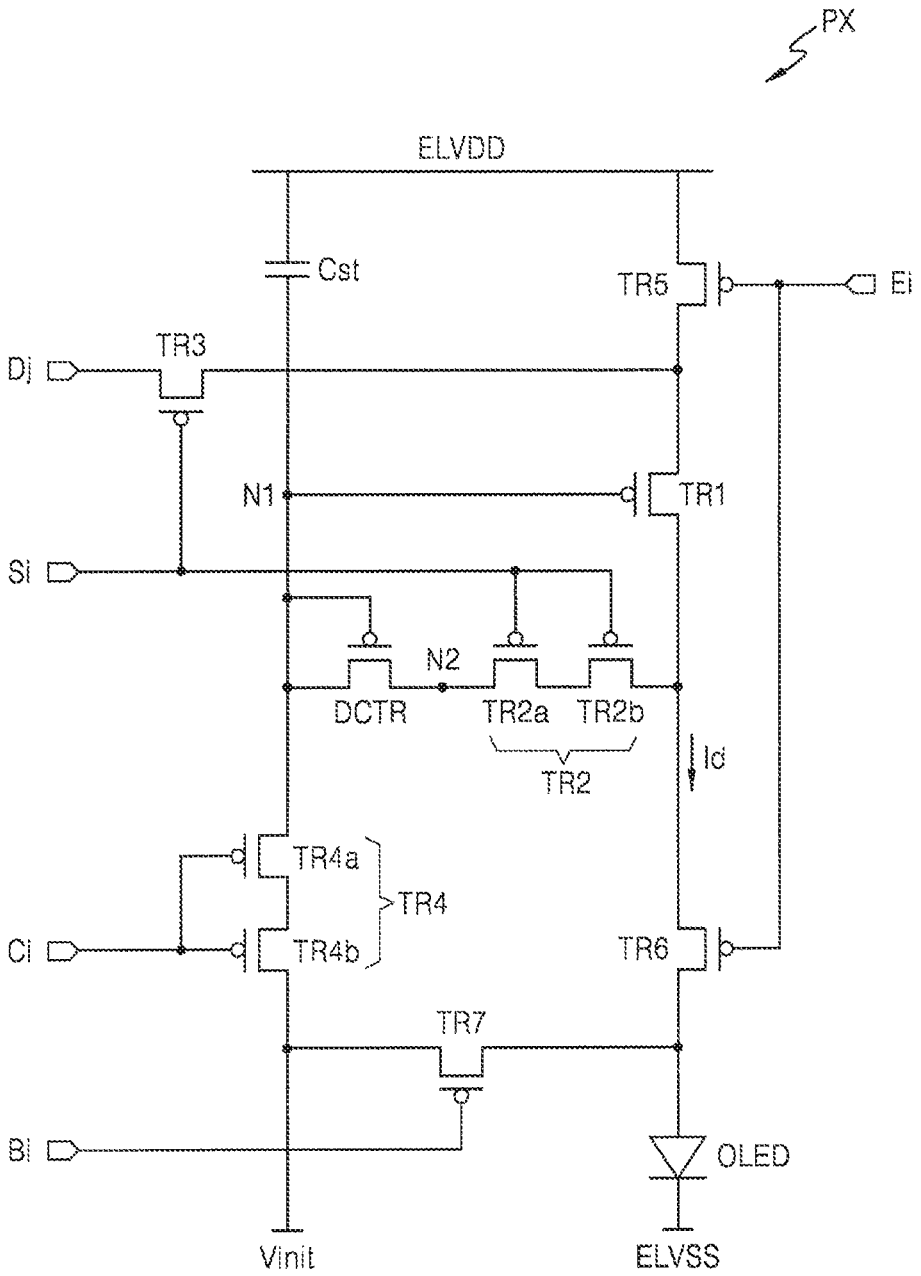
FIG. 5 is a circuit diagram illustrating a pixel according to another embodiment.

FIG. 5 is a circuit diagram illustrating a pixel PX according to another embodiment.

Referring to FIG. 5, the pixel PX includes an OLED, first through seventh transistors TR1 through TR7, a storage capacitor Cst, and a diode-connected transistor DCTR. The pixel PX may be controlled according to the timing chart illustrated in FIG. 4B. The pixel PX of FIG. 5 may be substantially the same as the pixel of FIG. 4A except the second transistor TR2 and the fourth transistor TR4. Therefore, detail descriptions thereof will be omitted.

The diode-connected transistor DCTR may be connected between the first node N1 and the second node N2. The diode-connected transistor DCTR includes a gate and a drain, which are commonly connected to the first node N1, and a source which is connected to the second node N2. When a voltage of the second node N2 is higher than a voltage of the first node N1 by an absolute value of a threshold voltage of the diode-connected transistor DCTR, the diode-connected transistor DCTR is turned on.

The second transistor TR2 connects a drain of the first transistor TR1 to the second node N2 in response to the first control signal Si. The second transistor TR2 is connected to the first node through the diode-connected transistor DCTR. When the diode-connected transistor DCTR is turned on, the gate and the drain of the first transistor TR1 are electrically connected to each other, and the first transistor TR1 is in a diode-connection. When the first transistor TR1 is in diode-connection, the compensating voltage of Dj+Vth, in which a threshold voltage Vth of the first transistor TR1 is reflected to the data voltage Dj, is stored in the first electrode of the storage capacitor Cst.

The second transistor TR2 may include a pair of transistors TR2*a* and TR2*b* which are substantially simultaneously (or concurrently) controlled by the first control signal Si and are connected to each other in series. When the second transistor TR2 is turned off, all of the pair of transistor TR2*a* and TR2*b* are turned off, and thus, a leakage of a current, which flows from or into a first electrode of the storage capacitor Cst, that is, the first node N1, may be reduced.

The fourth transistor TR4 supplies the initializing voltage Vinit to the first node N1 in response to the second control signal Ci. When the initializing voltage Vinit is supplied to the first node N1, the first transistor TR1 is full-turned on. The initializing voltage Vinit is set to a voltage to full-turn on the first transistor TR1.

The fourth transistor TR4 may include a pair of transistors TR4*a* and TR4*b* which are substantially simultaneously (or concurrently) controlled by the second control signal Ci and are connected to each other in series. When the fourth transistor TR4 is turned off, all of the pair of transistors TR4*a* and TR4*b* are turned off, and thus, a leakage of a current, which flows from or into the first electrode of the storage capacitor Cst, that is, the first node N1, the may be reduced.

In another embodiment, the second transistor TR2 includes a pair of transistors TR2*a* and TR2*b* which are connected in series, or the fourth transistor TR4 includes a pair of transistors TR4*a* and TR4*b* which are connected in series.

When the first control signal Si is changed to the turn-off level, the first control signal Si includes the rising edge. Since there is parasitic capacitance between the gate and the drain of the second transistor TR2, the voltage of the second node N2 is increased in response to the rising edge of the first control signal Si. However, since the diode-connected transistor DCTR is connected between the second node N2 and the first node N1, the gate of the second transistor TR2 and the gate of the first transistor TR1 are not directly capacitance-coupled to each other, and the voltage of the first node n1 may not be increased in response to the rising edge of the first control signal Si or the amount of the increased voltage is reduced. Accordingly, when the threshold voltage of the second transistor TR2 is changed or the parasitic capacitance between the gate and the drain of the second transistor TR2 is changed, the voltage of the first node N1 may be stably maintained.

It should be understood that embodiments described herein should be considered in a descriptive sense only and not for purposes of limitation. Descriptions of features or aspects within each embodiment should typically be considered as available for other similar features or aspects in other embodiments.

While the inventive technology has been described with reference to the figures, it will be understood by those of ordinary skill in the art that various changes in form and details may be made therein without departing from the spirit and scope as defined by the following claims.

What is claimed is:

1. A pixel circuit comprising:

an organic light-emitting diode (OLED);

a driving transistor including a source electrode, a drain electrode, and a gate electrode which is directly connected to a first node, wherein the driving transistor is configured to supply a driving current to the OLED based on a voltage of the gate electrode;

a storage capacitor electrically connected to the first node;

a compensating transistor electrically connected between the first node and the drain electrode of the driving transistor and configured to be controlled by a scan signal; and a diode-connected transistor between the first node and the compensating transistor, wherein the diode-connected transistor includes a drain electrode and a gate electrode which are directly connected to the first node, and a source electrode which is connected to the drain electrode of the driving transistor via the compensating transistor.

2. The pixel circuit of claim 1, wherein the absolute value of a threshold voltage of the driving transistor is greater than the absolute value of a threshold voltage of the diode-connected transistor.

3. The pixel circuit of claim 1, wherein when the compensating transistor is opened, the source electrode of the diode-connected transistor is not connected to the drain electrode of the driving transistor.

4. The pixel circuit of claim 1, wherein the compensating transistor comprises a pair of transistors that are connected in series and configured to be simultaneously turned on based on the scan signal.

5. The pixel circuit of claim 1, further comprising a scan transistor configured to transmit a data voltage to the source electrode of the driving transistor in response to the scan signal.

6. The pixel circuit of claim 1, further comprising a gate initializing transistor configured to transmit an initializing voltage to the first node in response to a gate initializing signal.

7. The pixel circuit of claim 6, wherein the gate initializing transistor comprises a pair of transistors connected in series and configured to be simultaneously turned on according to the gate initializing signal.

8. The pixel circuit of claim 1, further comprising an anode initializing transistor configured to transmit an initializing voltage to an anode electrode of the OLED in response to an anode initializing signal.

9. The pixel circuit of claim 1, further comprising an emission control transistor configured to transmit a first driving voltage to the source electrode of the driving transistor in response to an emission control signal.

10. The pixel circuit of claim 1, further comprising an emission control transistor configured to electrically connect the drain electrode of the driving transistor to an anode electrode of the OLED in response to an emission control signal.

11. A pixel circuit comprising:

a scan line configured to transmit a first control signal a data line configured to transmit a data voltage in synchronization with the first control signal;

an organic light-emitting diode (OLED);

a driving transistor including a source electrode, a drain electrode, and a gate electrode which is directly connected to a first node, wherein the driving transistor is configured to supply a driving current to the OLED based on a voltage of the gate electrode;

a storage capacitor electrically connected to the first node;

a diode-connected transistor between the first node and a compensating transistor, wherein the diode-connected transistor includes a drain electrode and a gate electrode which are directly connected to the first node, and a source electrode which is connected to the drain electrode of the driving transistor via the compensating transistor; and a switching transistor directly connected between the data line and the source electrode of the driving transistor and configured to transfer the data voltage from the data line to the source electrode of the driving transistor in response to the first control signal.

12. The pixel circuit of claim 11, further comprising the compensating transistor directly connected between the source electrode of the diode-connected transistor and the drain electrode of the driving transistor and configured to connect the source electrode of the diode-connected transistor to the drain electrode of the driving transistor in response to the first control signal.

13. The pixel circuit of claim 12, wherein the compensating transistor comprises a pair of transistors connected in series and configured to be simultaneously, turned on according to the first control signal.

14. An organic light-emitting diode (OLED) display comprising:

a display panel comprising a plurality of pixels, each pixel comprising:

an OLED;

a driving transistor including a source electrode, a drain electrode and a gate electrode which is directly connected to a first node, wherein the driving transistor is configured to supply a driving current to the OLED according to a voltage of the gate electrode;

a storage capacitor electrically connected to the first node;

a compensating transistor electrically connected between the first node and the drain of the driving transistor, wherein the compensating transistor is configured to be controlled by a first control signal; and a diode-connected transistor between the first node and the compensating transistor, wherein the diode-connected transistor includes a drain electrode and a gate electrode which are directly connected to the first node, and a source electrode which is connected to the drain electrode of the driving transistor via the compensating transistor.

15. The display of claim 14, wherein the absolute value of a threshold voltage of the driving transistor is greater than the absolute value of a threshold voltage of the diode-connected transistor.

16. The display of claim 14, wherein the compensating transistor comprises a pair of transistors connected in series and configured to be simultaneously turned on based on the first control signal.

17. The display of claim 14, wherein each pixel comprises:

a scan transistor configured to transmit a data voltage to the source electrode of the driving transistor in response to the first control signal;

a gate initializing transistor configured to transmit an initializing voltage to the first node in response to a second control signal;

a first emission control transistor configured to transmit a first driving voltage to the source electrode of the driving transistor in response to a third control signal; and a second emission control transistor configured to electrically connect the drain electrode of the driving transistor to an anode electrode of the OLED in response to the third control signal.

18. The display of claim 14, wherein each of the pixels comprises an anode initializing transistor configured to transmit an initializing voltage to an anode electrode of the OILED in response to a fourth control signal.

19. The display of claim 14, wherein when the compensating transistor is opened, the source electrode of the diode-connected transistor is not connected to the drain electrode of the driving transistor.

* * * * *